US008079503B1

(12) United States Patent
Yeates et al.

(10) Patent No.: US 8,079,503 B1
(45) Date of Patent: Dec. 20, 2011

(54) MODULAR EQUIPMENT COUPLER

(75) Inventors: Eric M. Yeates, Virginia Beach, VA (US); Matt M. McCune, Bozeman, MT (US); Robert A. Kincaid, Bozeman, MT (US); Thomas M. Gregory, Belgrade, MT (US)

(73) Assignee: Blackhawk Industries Product Group Unlimited LLC, Norfolk, VA (US)

( * ) Notice: Subject to any disclaimer, the term of this patent is extended or adjusted under 35 U.S.C. 154(b) by 1026 days.

(21) Appl. No.: 11/703,882

(22) Filed: Feb. 8, 2007

Related U.S. Application Data

(60) Provisional application No. 60/771,595, filed on Feb. 8, 2006, provisional application No. 60/847,596, filed on Sep. 27, 2006.

(51) Int. Cl.
*A44B 21/00* (2006.01)

(52) U.S. Cl. ..... 224/666; 224/665; 224/268; 224/269; 24/578.1; 24/3.7

(58) Field of Classification Search ..... 224/255, 224/256, 268, 269, 645, 666, 667, 668, 665, 224/675; 24/3.7, 578.1, 578.13, 578.17, 24/DIG. 31, DIG. 32, DIG. 33, DIG. 37, 24/370, 371
See application file for complete search history.

(56) References Cited

U.S. PATENT DOCUMENTS

| | | | | |
|---|---|---|---|---|
| 842,498 | A * | 1/1907 | Schmidt | 24/578.1 |
| 2,791,784 | A * | 5/1957 | Tomsic | 5/496 |
| 3,509,581 | A * | 5/1970 | Lewis | 2/240 |
| 4,828,153 | A * | 5/1989 | Guzik et al. | 224/242 |
| 5,232,137 | A * | 8/1993 | Devine | 224/666 |
| 5,259,093 | A * | 11/1993 | D'Annunzio | 24/3.9 |
| 5,515,582 | A * | 5/1996 | Trowbridge | 24/370 |
| 5,632,071 | A * | 5/1997 | Maunder | 24/580.1 |
| 5,724,707 | A * | 3/1998 | Kirk et al. | 24/3.7 |
| 6,279,804 | B1 * | 8/2001 | Gregg | 224/675 |
| 6,547,118 | B2 * | 4/2003 | Beletsky et al. | 224/661 |
| 2005/0015943 | A1 * | 1/2005 | Wemmer | 24/580.1 |
| 2007/0289045 | A1 * | 12/2007 | Evans et al. | 2/102 |

FOREIGN PATENT DOCUMENTS

WO WO 2005027686 A1 * 3/2005

* cited by examiner

*Primary Examiner* — Justin Larson
*Assistant Examiner* — Steven M Landolfi, Jr.
(74) *Attorney, Agent, or Firm* — Wooten & Shaddock, PLC

(57) ABSTRACT

A coupling member for removably attaching an accessory to a carrier, wherein the coupling member includes an elongate portion of material having a first end portion, an intermediate portion, and a second end portion. At least one hook is formed from a portion of the first end portion, wherein the hook formed from the first end portion allows the first end portion of the coupling member to be removably secured to an accessory webbing or a carrier webbing when the coupling member has been interwoven between aligned carrier tunnel segments and accessory tunnel segments of an accessory and carrier. The coupling member may optionally include a hook formed from a portion of the second end portion.

12 Claims, 8 Drawing Sheets

MODULAR EQUIPMENT COUPLER

CROSS-REFERENCE TO RELATED APPLICATIONS

This application claims the benefit of U.S. Provisional Patent Application Ser. No. 60/771,595 filed Feb. 8, 2006, and U.S. Provisional Patent Application Ser. No. 60/847,596 filed Sep. 27, 2006, the entire disclosures of which are incorporated herein by reference.

BACKGROUND OF THE INVENTION

1. Field of the Invention

This invention relates generally to couplers or connectors. In particular, the present invention relates to a coupling member, which can be used to attach modular load-carrying equipment.

2. Description of Related Art

Military and law enforcement personnel, particularly those attached to special operations unit, carry a large amount of specially designed and adapted gear. Because of the constantly changing landscape of the modern battlefield, and the rapidly changing mission of law enforcement, it is advantageous for operators to be able to configure and/or reconfigure pouches, pockets, holsters, holders, and other accessories on vests, body armor, packs, platforms, and other carriers.

The interchangeability of pouches, pockets, and accessories is of particular importance because it allows, for example, a single load-bearing vest to be reconfigured to meet certain mission specific needs.

The terms MOLLE (Modular Lightweight Load-carrying Equipment) or S.T.R.I.K.E. (Soldier Tactical Retro Integrated Kit Enhanced) are used to generically describe load bearing systems and subsystems that utilize corresponding rows of woven webbing for modular pouch, pocket, and accessory attachment. Generally, the terms MOLLE and S.T.R.I.K.E. are interchangeable.

The MOLLE system of attachment was originally developed by the U.S. Army Soldier Systems Center as a replacement for the ALICE (All-purpose Lightweight Individual Carrying Equipment) or LCE (Load-Carriage Equipment) "clip" load carrying systems. The MOLLE system is a modular system that incorporates the use of corresponding rows of nylon webbing stitched onto a piece of equipment, such as a vest, and the various MOLLE-compatible pouches, pockets, and accessories. MOLLE-compatible pouches, pockets, and accessories of various utility can then be attached wherever MOLLE webbing exists on the equipment.

Thus, through the use of a MOLLE-type system, a given accessory may be mounted to a variety of carriers. Likewise, if a particular carrier includes a MOLLE-compatible system, a variety of accessories may be interchangeably mounted to the platform to accommodate a variety of mission load-outs.

MOLLE or S.T.R.I.K.E.-compatible systems allow an operator to specifically tailor a load to an individual mission and help decrease the bulk, uncomfort, and breakage that was associated with the ALICE/LCE load attachment systems. The S.T.R.I.K.E. assembly can be configured or reconfigured to meet changing or dissimilar operational requirements. Mission essential pouches, pockets, and accessories can be added and unnecessary pouches, pockets, or accessories can be removed.

Currently, MOLLE or S.T.R.I.K.E.-compatible components are attached in one of four ways. The first method utilizes a webbing strap, which is permanently affixed to the accessory. The webbing strap is woven between subsequent rows of webbing and is attached to the accessory via a snap at a terminating end. The second method uses a webbing strap that is permanently affixed to the accessory. After the webbing strap has been woven between subsequent rows of webbing, the terminating end of the interwoven strap is tucked into the accessory's backing. The third method utilizes a locking loop, which is also woven between subsequent rows of webbing, but terminates in a semi-permanent closure that requires a screwdriver/flat-tipped object to disengage. The fourth method utilizes a combination of a permanently affixed, Velcro covered, tuckable strap and snaps to affix an accessory to a vest or platform.

SUMMARY OF THE INVENTION

However, the current strap and locking loop methods of attaching MOLLE or S.T.R.I.K.E.-compatible components are often too tedious and time consuming for the user to employ easily and, many times, even completely or successfully. Likewise, many of the components of the current strap and locking loop methods stretch with age and use, and tend to allow the attached items to sag, pull away from the body, and create difficulty for the wearer by not being stable on the body. These same shortcomings also come into play when a strap is not completely fastened.

Even when the components of the current strap and locking loop systems are assembled correctly, the strap components can still fail when snaps or closures fail, break, or tear out of the component to which they are attached. Woven straps can be torn from an accessory or become untucked or unwoven. If a component of the current fabric-based webbing strap systems fails, the failure cannot be easily repaired, particularly if the failure occurs in the field, and typically requires that the entire affected accessory be replaced.

The present invention relates generally to a coupling member that can be used alone or in conjunction with other similar coupling members to removably attach accessories to a carrier or platform in a manner that is easier for a user, surpasses thread-on stability, and simulates the performance benefits of sewn on stability.

In various exemplary, non-limiting embodiments, the coupling member comprises an elongate portion of material having a first end portion, an intermediate portion, and a second end portion. The coupling member is formed so as to removably attach at least one accessory to a carrier. An exemplary carrier includes a plurality of substantially parallel, spaced apart carrier webbings. Each of the carrier webbings is secured to the carrier at spaced apart locations, such that a carrier tunnel segment is formed between the carrier and the carrier webbing between each secured location of the carrier webbing. Each of the carrier tunnel segments is formed substantially perpendicular to a longitudinal direction of the carrier webbing.

Similarly, an exemplary accessory includes a plurality of substantially parallel, spaced apart accessory webbings. The accessory webbings are spaced apart so as to correspond to the spaces between the spaced apart carrier webbings. The accessory webbings are secured to the accessory at spaced apart locations, such that an accessory tunnel segment is formed between the accessory and the accessory webbing between each secured location of the accessory webbing. Each of the accessory tunnel segments is formed substantially perpendicular to a longitudinal direction of the accessory webbing.

When the accessory is placed adjacent the carrier such that the accessory webbings are within the spaces between the spaced apart carrier webbings (and the carrier webbings are within the spaces between the spaced apart accessory webbings) and corresponding carrier tunnel segments and accessory tunnel segments are aligned, the coupling member may be interwoven between the aligned carrier tunnel segments and accessory tunnel segments to removably attach the accessory to the carrier.

In various exemplary, non-limiting embodiments of this invention, the coupling member comprises a hook or catch formed from a portion of the first end portion. The hook or catch allows the coupling member to be removably secured to a last accessory webbing or carrier webbing when the coupling member has been interwoven between the aligned carrier tunnel segments and accessory tunnel segments.

In still other exemplary, non-limiting embodiments, the coupling member comprises a first hook or catch formed from a portion of the first end portion and a second hook or catch formed from a portion of the second end portion. The first hook or catch formed from the first end portion allows the first end portion of the coupling member to be removably secured to a last accessory webbing or carrier webbing when the coupling member has been interwoven between the aligned carrier tunnel segments and accessory tunnel segments.

Likewise, the second hook or catch formed from the second end portion allows the second end portion of the coupling member to be removably secured to a first accessory webbing or carrier webbing when the coupling member has been interwoven between the aligned carrier tunnel segments and accessory tunnel segments.

In various exemplary, non-limiting embodiments, the coupling member comprises one or more protrusions formed from a portion of the second end portion, which provide a user with a convenient area to hold the coupling member when inserting or removing the coupling member. In various exemplary, non-limiting embodiments, the protrusions may form a type of "T"-handle on the second end portion.

Accordingly, this invention provides a coupling member of improved design.

This invention separately provides a coupling member, which is capable of allowing accessories to be removably attached to a carrier or platform.

This invention separately provides a coupling member, which simulates the performance benefits of sewn on stability.

This invention separately provides a low bulk coupling member, which has little weight and a relatively flat profile.

This invention separately provides a coupling member, which provides for "quiet" adjustment of accessories.

This invention separately provides a coupling member, which is capable of providing enough flex to be comfortable while still eliminating the "sagging" that is commonly associated, through time, age, and use, with the current fabric-based webbing strap systems.

This invention separately provides a coupling member, which can easily be replaced, if necessary, even in the field.

This invention separately provides a coupling member, which is compact enough to allow a user to easily carry extra coupling members.

This invention separately provides a coupling member, which does not rely on the user having to activate, depress, open, or separate a mechanical means to be engaged or disengaged.

This invention separately provides a coupling member, having edges and contours that can be shaped to minimize any damage to either the wearer or the attached accessory or carrier.

These and other features and advantages of this invention are described in or are apparent from the following detailed description of the exemplary embodiments.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF EXEMPLARY EMBODIMENTS

For simplicity and clarification, the design factors and operating principles of the coupling member according to this invention are explained with reference to various exemplary embodiments of a coupling member according to this invention. The basic explanation of the design factors and operating principles of the coupling member is applicable for the understanding, design, and operation of the coupling member of this invention.

Furthermore, it should be appreciated that, for simplicity and clarification, the embodiments of this invention will be described with reference to one or more pouches, pockets, or accessories being attached to a MOLLE or S.T.R.I.K.E. portion of a backpack. However, it should be appreciated that a plurality of various rigid, semi-rigid, or soft pouches, pockets, carriers, bags, holders, holsters, accessories, or the like may be attached to any MOLLE- or S.T.R.I.K.E.-type portion of any garment, vest, modular load bearing vest, carrier, Fighting Load Carrier (FLC), backpack, rucksack, platform or the like, using the design factors, methods, and principles of this invention.

It should also be appreciated that, as used herein, the terms "MOLLE" and "S.T.R.I.K.E." are used for basic explanation and understanding of the operation of the systems, methods, and apparatuses of this invention. Therefore, the terms "MOLLE" and "S.T.R.I.K.E." are not to be construed as limiting the systems, methods, and apparatuses of this invention. Thus, the terms "MOLLE" and "S.T.R.I.K.E." are to be understood to broadly include any and all systems and subsystems that utilize spaced attachments for woven, modular pouch or accessory attachment.

Figure 1:
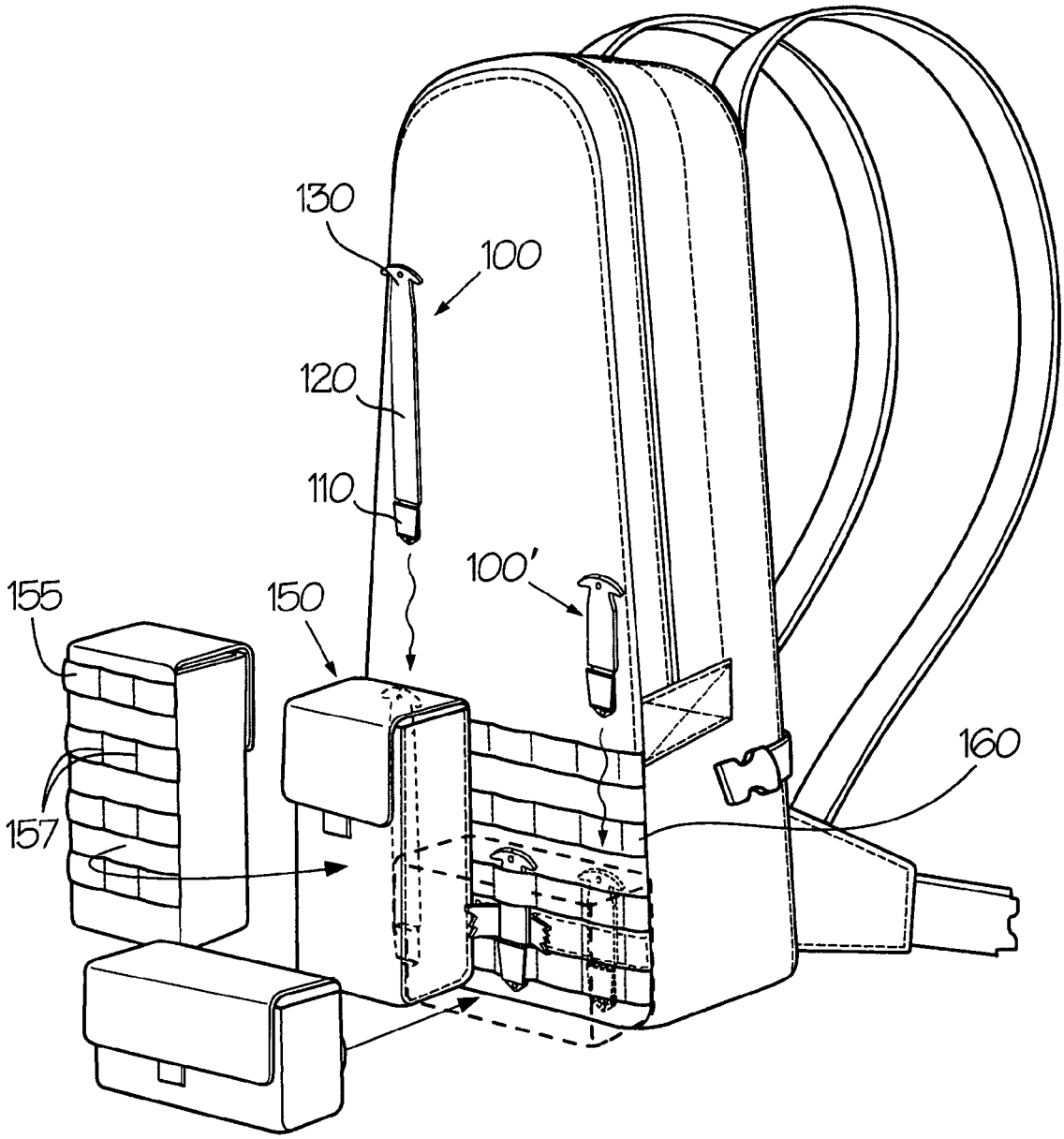
FIG. 1 shows a perspective view of an exemplary embodiment of a coupling member used to removably attach an accessories to a carrier, according to this invention.
Figure 2:
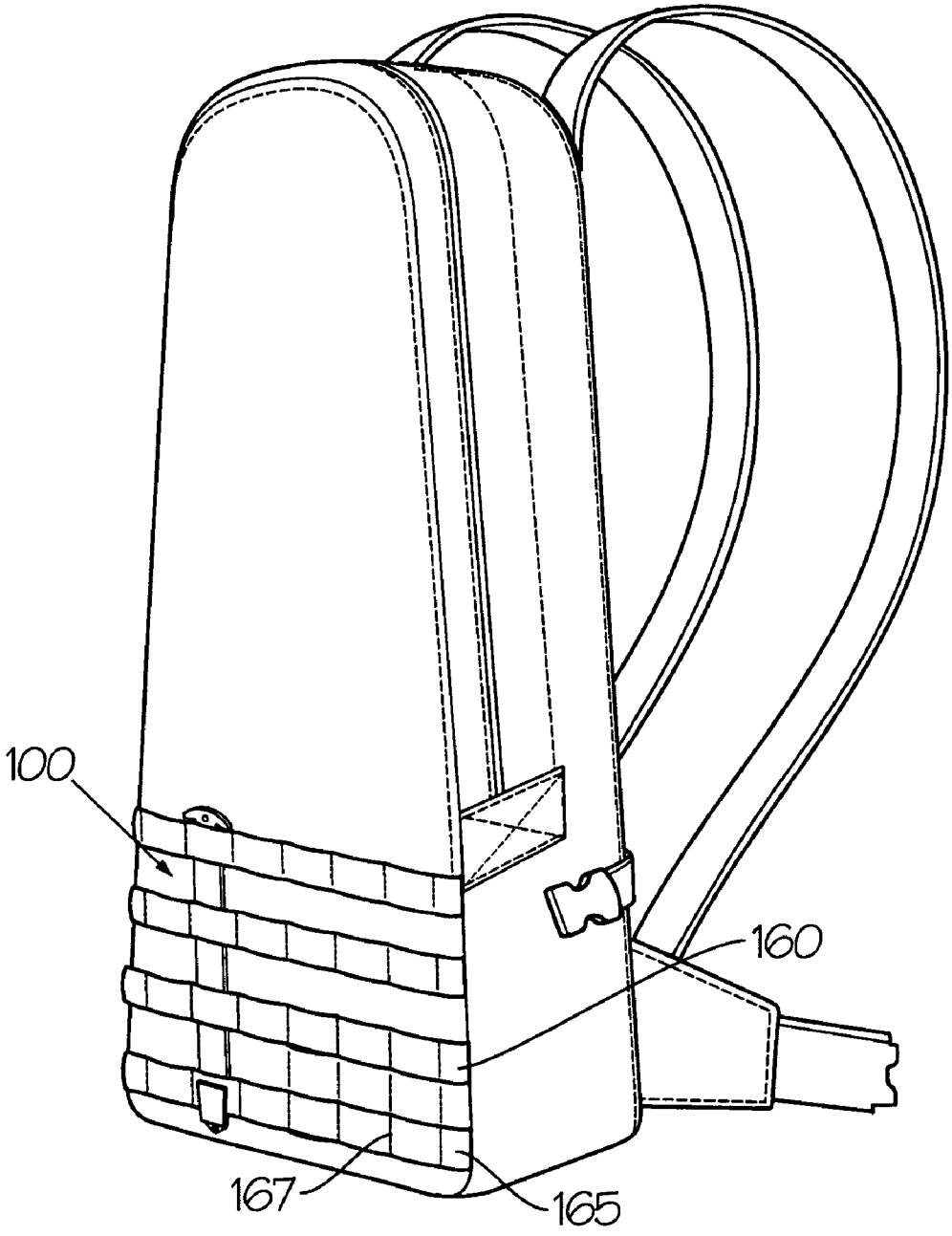
FIG. 2 shows a perspective view of a first exemplary embodiment of a coupling member removably attach to a carrier, according to this invention.

Turning now to FIGS. 1 and 2, FIG. 1 shows a perspective view of a first exemplary embodiment of a coupling member 100 used to removably attach an accessory to a carrier, while FIG. 2 shows a perspective view of a first exemplary embodiment of a coupling member 100 removably attach to a carrier, according to this invention.

As illustrated in FIGS. 1 and 2, the coupling member 100 comprises an elongate portion of material having a first end portion 110, an intermediate portion 120, and a second end portion 130.

In various exemplary embodiments, the coupling member 100 is formed of a rigid or a semi-rigid plastic or polymeric material, such as a polymeric composite. In various exemplary embodiments, the coupling member 100 is injection-molded. Alternatively, the coupling member 100 may be heat-formed from sheet stock, such as, for example a polymer. In still other exemplary embodiments, the coupling member 100 may be stamped or rolled from a sheet of metal or may be formed from aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass or polymer fiber reinforced plastics, thermoform and/or thermoset sheet materials, and/or various combinations of the foregoing. It should also be appreciated that the coupling member 100 may be formed of, overmolded, or coated by multiple materials. Thus, it should be understood that the material or materials used to form the coupling member 100 is a design choice based on the desired appearance, flexibility, and functionality of the coupling member 100.

The edges and contours of the coupling member 100 may be shaped to minimize any damage to the wearer or the carrier, the carrier webbings, the accessory, or the accessory webbings.

The coupling member 100 is formed so as to removably attach at least one accessory to a carrier. As shown in FIG. 1, an exemplary carrier 160 includes a plurality of substantially parallel, spaced apart carrier webbings 165. Each of the carrier webbings 165 is secured to the carrier 160 at spaced apart locations 167, such that a carrier tunnel segment is formed between the carrier 160 and the carrier webbing 165 between each secured location 167 of the carrier webbing 165. Each of the carrier tunnel segments is formed substantially perpendicular to a longitudinal direction of the carrier webbing 165.

Similarly, an exemplary accessory pouch 150 includes a plurality of substantially parallel, spaced apart accessory webbings 155. The accessory webbings 155 are spaced apart so as to correspond to the spaces between the spaced apart carrier webbings 165. The accessory webbings 155 are secured to the accessory pouch 150 at spaced apart locations 157, such that an accessory tunnel segment is formed between the accessory pouch 150 and the accessory webbing 155 between each secured location 157 of the accessory webbing 155. Each of the accessory tunnel segments is formed substantially perpendicular to a longitudinal direction of the accessory webbing 155.

As shown in FIG. 1, the coupling member 100 comprises a hook 115 formed from a portion of the first end portion 110 and a hook 135 formed from a portion of the second end portion 130. The hook 115 formed from the first end portion 110 allows the first end portion 110 of the coupling member 100 to be removably secured to a last accessory webbing 155 or carrier webbing 165 when the coupling member 100 has been interwoven between the aligned carrier tunnel segments and accessory tunnel segments. Likewise, the hook 135 formed from the second end portion 130 allows the second end portion 130 of the coupling member 100 to be removably secured to a first accessory webbing 155 or carrier webbing 165 when the coupling member 100 has been interwoven between the aligned carrier tunnel segments and accessory tunnel segments.

In various exemplary, non-limiting embodiments, the coupling member 100 comprises a hook or catch 115 formed from a portion of the first end portion 110 and no hook or catch formed from a portion of the second end portion 130.

Alternatively, the coupling member 100 may comprise a hook or catch 135 formed from a portion of the second end portion 130 and no hook or catch formed from a portion of the first end portion 110.

As further shown in FIG. 1, an exemplary accessory pouch 150 is being attached to the carrier 160 to illustrate exemplary attachment of an accessory using the coupling member 100. When the accessory pouch 150 is placed adjacent the carrier 160 such that the accessory webbings 155 are within the spaces between the spaced apart carrier webbings 165 (and the carrier webbings 165 are within the spaces between the spaced apart accessory webbings 155) and corresponding carrier tunnel segments and accessory tunnel segments are aligned, the coupling member 100 may be interwoven between the aligned carrier tunnel segments and accessory tunnel segments to removably attach the accessory pouch 150 to the carrier 160.

In various exemplary embodiments, when the coupling member 100 has been laced through an initial carrier tunnel segment, the coupling member 100 is then laced through an initial accessory tunnel segment. When the coupling member 100 has been laced through the initial accessory tunnel segment, the coupling member 100 is then laced through a subsequent corresponding carrier tunnel segment. When the coupling member 100 has been laced through the subsequent corresponding carrier tunnel segment, the coupling member 100 is then laced through a subsequent corresponding accessory tunnel segment.

The coupling member 100 continues to be interlaced between the corresponding accessory tunnel segments and carrier tunnel segments, as described above, until either the entire coupling member 100 has been interlaced between the corresponding carrier and accessory tunnel segments or a last carrier tunnel segment or accessory tunnel segment has been utilized. As the coupling member 100 is laced through the corresponding carrier and accessory tunnel segments, the accessory pouch 150 is drawn towards and removably attached to the carrier 160.

As described above, the coupling member 100 is first laced through an initial carrier tunnel segment. However, it should be appreciated that, in various exemplary embodiments, the coupling member 100 may first be laced through an initial accessory tunnel segment.

Once the coupling member 100 has been interlaced between the corresponding accessory tunnel segments and carrier tunnel segments, the hook 115 is placed around a last carrier webbing 165 to further secure the coupling member 100 within the accessory tunnel segments and carrier tunnel segments. It should be appreciated that once the coupling member 100 has been interlaced between the corresponding accessory tunnel segments and carrier tunnel segments, the hook 115 may alternatively be placed around a last accessory webbing 155.

Once the coupling member 100 has been interlaced between the corresponding accessory tunnel segments and carrier tunnel segments, the optional hook 135, if included, is placed around a first carrier webbing 165 to further secure the coupling member 100 within the accessory tunnel segments and carrier tunnel segments. It should be appreciated that once the coupling member 100 has been interlaced between the corresponding accessory tunnel segments and carrier tunnel segments, the optional hook 135 may alternatively be placed around a first accessory webbing 155.

While the coupling member 100 has been described as being interlaced between the corresponding accessory tunnel segments and carrier tunnel segments, such that both a first end portion 110 and a second end portion 130 of the coupling member 100 are removably secured to a last accessory webbing 155 and a first accessory webbing 155, respectively (or a last carrier webbing 165 and a first carrier webbing 165, respectively), the coupling member 100 may be formed so as to allow the first end portion 110 to be removably secured to an accessory webbing 155 and the second end portion 130 to be removably secured to a carrier webbing 165, or vice versa.

Thus, while the embodiments of the coupling members illustrated in FIG. 1 show the coupling member 100 interlaced through four carrier tunnel segments and three accessory tunnel segments, it should also be appreciated that the coupling member 100 may be interlaced through as few as one carrier tunnel segment and one accessory tunnel segment to provide at least some connection between the accessory pouch 150 and the carrier 160.

While it is possible to achieve a minimal connection between an accessory and a carrier by interlacing the coupling member 100 through as few as one carrier tunnel segment and one accessory tunnel segment, the greater the number of interlaced carrier tunnel segments and accessory tunnel segments, the greater the connection between the accessory and the carrier.

It should also be appreciated that the coupling member 100 may be used alone or in conjunction with other similar coupling members to removably attach accessories to a carrier or platform. Thus, multiple coupling members may be used to removably attach an accessory to a carrier.

Because the total number of spaced apart carrier webbings 165 and spaced apart accessory webbings 155 may vary, the total length of the coupling member 100 may vary. The overall size of the coupling member of this invention is a design choice based on the desired appearance and functionality of the coupling member.

Figure 3:
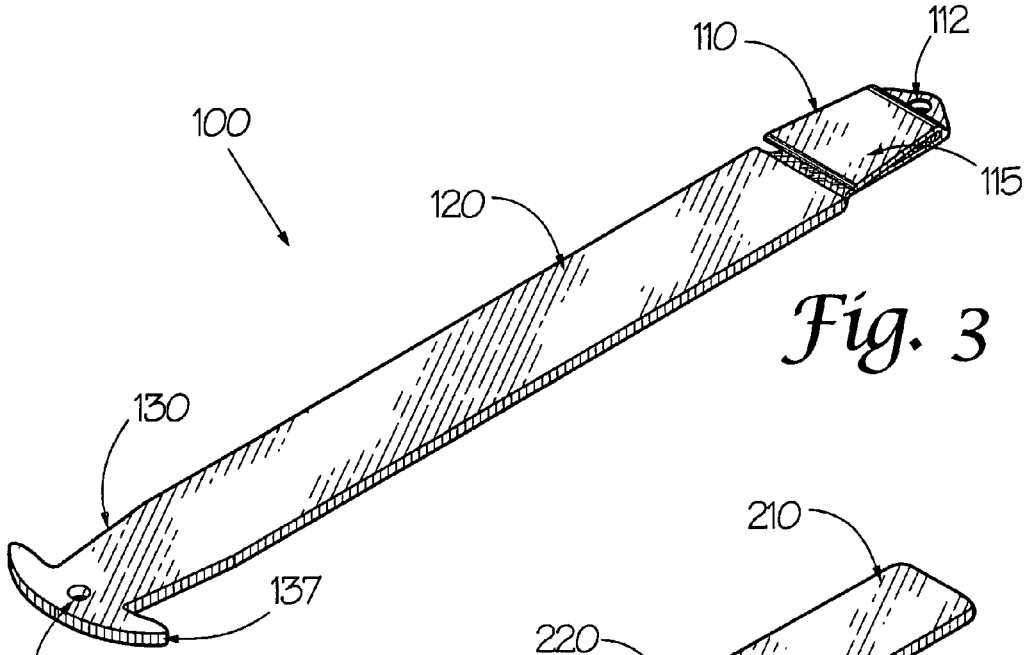
FIG. 3 shows a perspective view of a first exemplary embodiment of a coupling member according to this invention.

FIG. 3 shows an exemplary coupling member 100 having a first end portion 110, an intermediate portion 120, and a second end portion 130. As illustrated in FIG. 3, a hook or catch 115 is formed from a portion of the first end portion 110 and a "T"-handle protrusion 137 formed from a portion of the second end portion 130.

The hook or catch 115 formed from the first end portion 110 allows the first end portion 110 of the coupling member 100 to be removably secured to a last accessory webbing or carrier webbing when the coupling member 100 has been interwoven between aligned carrier tunnel segments and accessory tunnel segments.

The "T"-handle protrusion 137 on the second end portion 130 provides a user with a convenient area to hold the coupling member 100 when inserting or removing the coupling member 100. Additionally, the "T"-handle protrusion 137 on the second end portion 130 extends outward, a distance beyond the intermediate portion 120, so as to keep the "T"-handle protrusion 137 from traveling through a carrier tunnel segment or an accessory tunnel segment.

As shown in FIG. 3, each end portion also includes an optional aperture 112 and 132, respectively, which may be used, for example, to attach a lanyard or strap to the coupling member. It should be appreciated that the aperture(s) 112 and/or 132, if included may take any size or shape.

Figure 4:
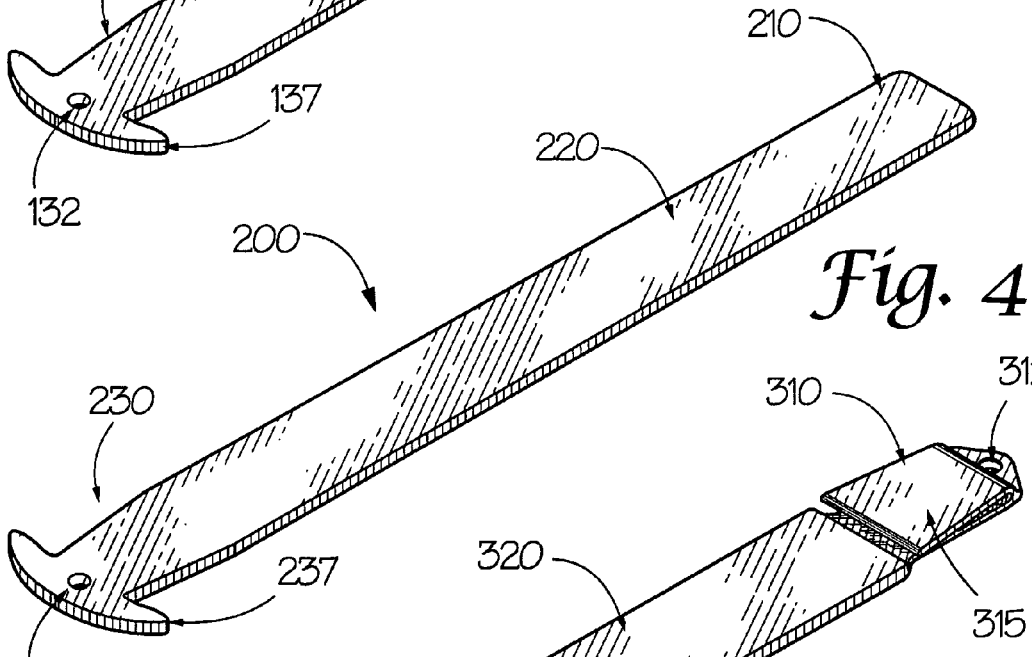
FIG. 4 shows a perspective view of a second exemplary embodiment of a coupling member according to this invention.

FIG. 4 shows a second exemplary coupling member 200 having a first end portion 210 that terminates in a relatively blunt terminal end and a "T"-handle protrusion 237 formed from a portion of the second end portion 230. As shown in FIG. 4, the second end portion 230 also includes an optional aperture 232, which may be used, for example, to attach a lanyard or strap to the coupling member. It should be appreciated that, in various exemplary embodiments, the first end portion 210 may optionally include an appropriate aperture 212 (not shown). It should also be appreciated that the aperture(s) 212 and/or 232, if included may take any size or shape.

Figure 5:
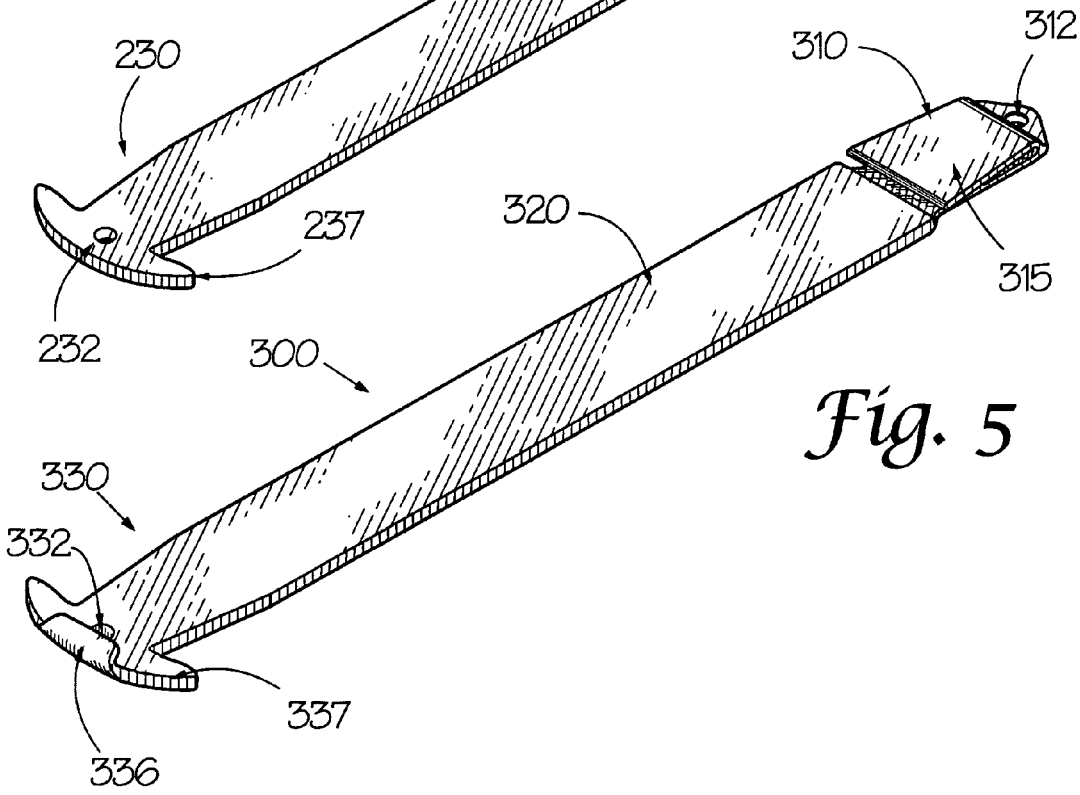
FIG. 5 shows a perspective view of a third exemplary embodiment of a coupling member according to this invention.

FIG. 5 shows an exemplary coupling member 300 having a hook or catch 315 formed from a portion of the first end portion 310 and a "T"-handle protrusion 337 formed from a portion of the second end portion330. As shown in FIG. 5, each end portion also includes an optional aperture 312 and 332, respectively, which may be used, for example, to attach a lanyard or strap to the coupling member. It should be appreciated that the aperture(s) 312 and/or 332, if included may take any size or shape.

As further shown in FIG. 5, the coupling member 300 also includes a small curved protrusion 336 formed from a portion of the second end portion 330. The curved end portion 336, if included, may curve towards either side of the coupling member 300 and may be used to aid the user in insertion and removal of the coupling member 300.

Figure 6:
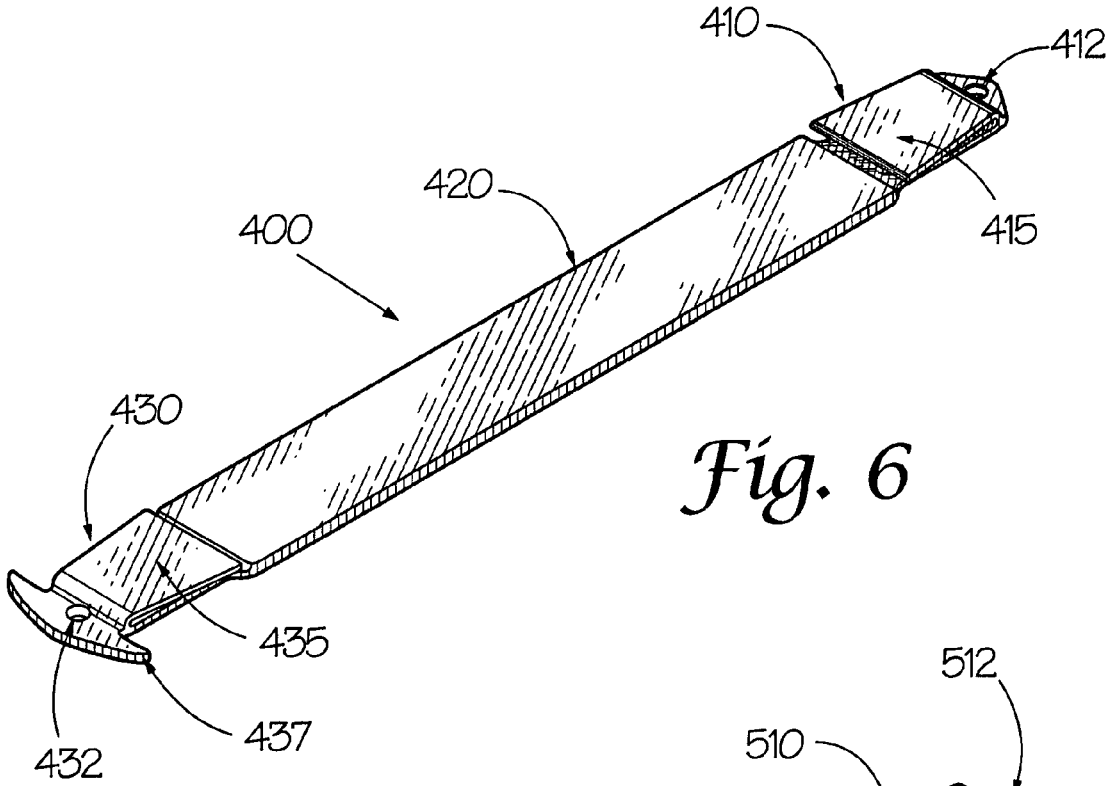
FIG. 6 shows a perspective view of a fourth exemplary embodiment of a coupling member according to this invention.

FIG. 6 shows an exemplary coupling member 400 having a hook or catch 415 formed from a portion of the first end portion 410 and a hook or catch 435 formed from a portion of the second end portion 430. The exemplary coupling member 400 also includes a "T"-handle protrusion 437 formed from a portion of the second end portion 430.

The hook or catch 415 formed from the first end portion 410 allows the first end portion 410 of the coupling member 400 to be removably secured to a last accessory webbing or carrier webbing when the coupling member 400 has been interwoven between the aligned carrier tunnel segments and accessory tunnel segments. Likewise, the hook or catch 435 formed from the second end portion 430 allows the second end portion 430 of the coupling member 400 to be removably secured to a first accessory webbing or carrier webbing when the coupling member 400 has been interwoven between the aligned carrier tunnel segments and accessory tunnel segments.

The "T"-handle protrusion 437 of the second end portion 430 provides a user with a convenient area to hold the coupling member 400 when inserting or removing the coupling member 400. Additionally, the "T"-handle protrusion 437 on the second end portion 430 extends outward, a distance beyond the intermediate portion 420, so as to keep the "T"-handle protrusion 437 from traveling through a carrier tunnel segment or an accessory tunnel segment.

As shown in FIG. 6, each end portion also includes an optional aperture 412 and 432, respectively, which may be used, for example, to attach a lanyard or strap to the coupling member. It should be appreciated that the aperture(s) 412 and/or 432, if included may take any size or shape.

Figure 7:
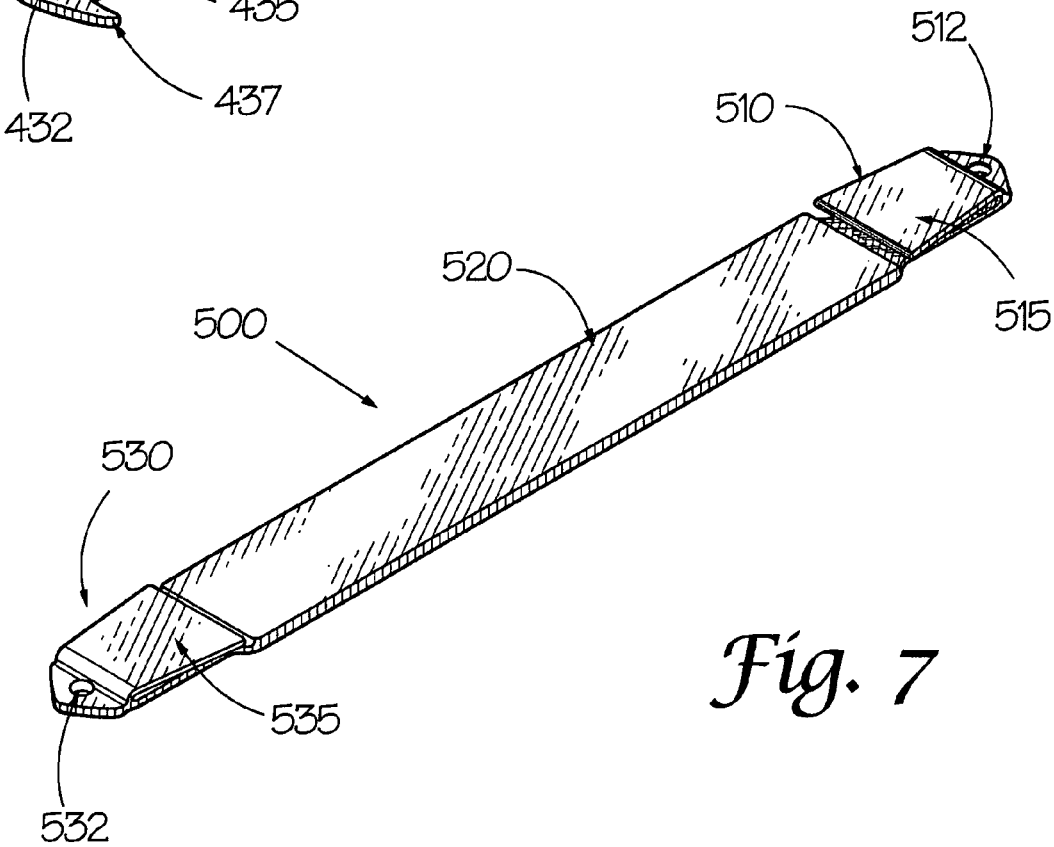
FIG. 7 shows a perspective view of a fifth exemplary embodiment of a coupling member according to this invention.

FIG. 7 shows an exemplary coupling member 500 having a hook or catch 515 formed from a portion of the first end portion 510 and a hook or catch 535 formed from a portion of the second end portion 530.

The hook or catch 515 allows the first end portion 510 to be removably secured to a last accessory webbing or carrier webbing when the coupling member 500 has been interwoven between the aligned carrier tunnel segments and accessory tunnel segments. Likewise, the hook or catch 535 allows the second end portion 530 to be removably secured to a first accessory webbing or carrier webbing when the coupling member 500 has been interwoven between the aligned carrier tunnel segments and accessory tunnel segments.

As shown in FIG. 7, each end portion also includes an optional aperture 512 and 532, respectively, which may be used, for example, to attach a lanyard or strap to the coupling member. It should be appreciated that the aperture(s) 512 and/or 532, if included may take any size or shape.

Figure 8:
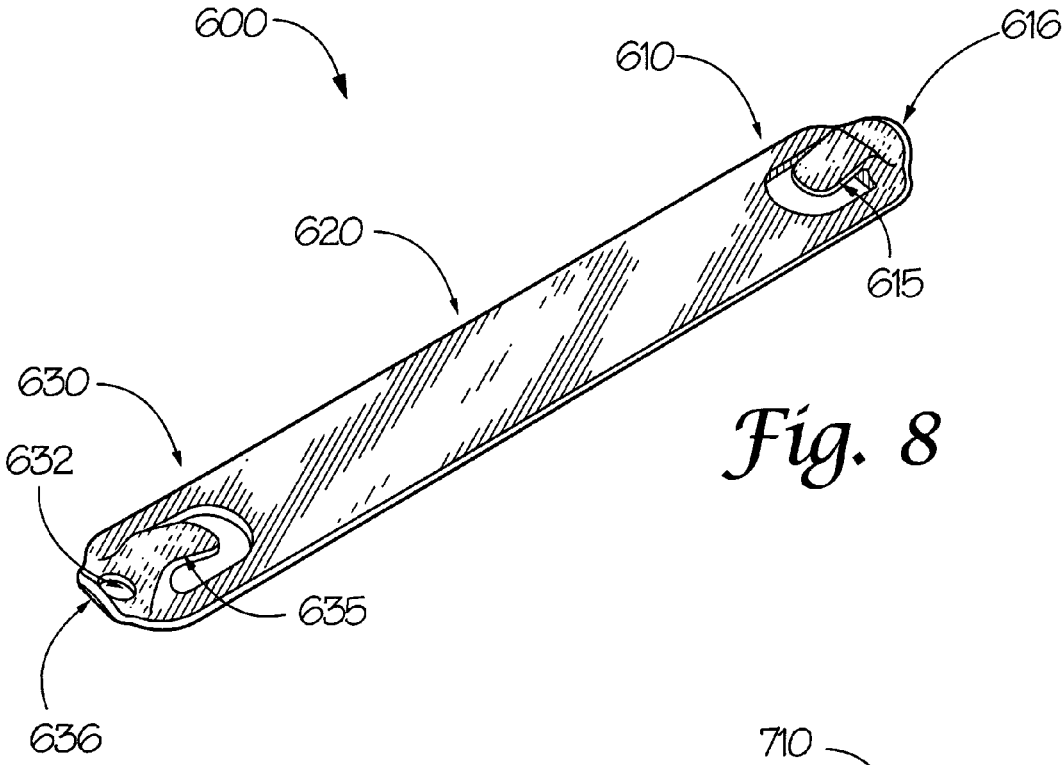
FIG. 8 shows a perspective view of a sixth exemplary embodiment of a coupling member according to this invention.

FIG. 8 shows a sixth exemplary embodiment of a coupling member according to this invention. As illustrated in FIG. 8, the exemplary coupling member 600 includes at least some of a first end portion 610, an intermediate portion 620, and a second end portion 630. As illustrated in FIG. 8, a hook 615 is formed integral to a portion of the first end portion 610 and a hook 635 is formed integral to a portion of the second end portion 630.

As illustrated in FIG. 8, the coupling member 600 comprises an elongate portion of material having a first end portion 610, an intermediate portion 620, and a second end portion 630.

The edges and contours of the coupling member 600 may be shaped to minimize any damage to the wearer or the carrier, the carrier webbings, the accessory, or the accessory webbings.

Furthermore, as illustrated in FIG. 8, a portion of the first end portion 610 and/or the second end portion 630 may optionally include a curved end portion 616 and/or 636, respectively. Alternatively, the first end portion 610 and/or the second end portion 630 may terminate in a relatively planar end portion.

As shown in FIG. 8, the second end portion 630 also includes an optional aperture 632, which may be used, for example, to attach a lanyard or strap to the coupling member. It should be appreciated that, in various exemplary embodiments, the first end portion 610 may optionally include an appropriate aperture 612 (not shown). It should also be appreciated that the aperture(s) 612 and/or 632, if included may take any size or shape.

In various exemplary, non-limiting embodiments, the coupling member 600 comprises a hook or catch 615 formed integral to a portion of the first end portion 610 and no hook or catch formed integral to a portion of the second end portion 630.

Alternatively, the coupling member 600 may comprise a hook or catch 635 formed integral to a portion of the second end portion 630 and no hook or catch formed integral to a portion of the first end portion 610.

Figure 9:
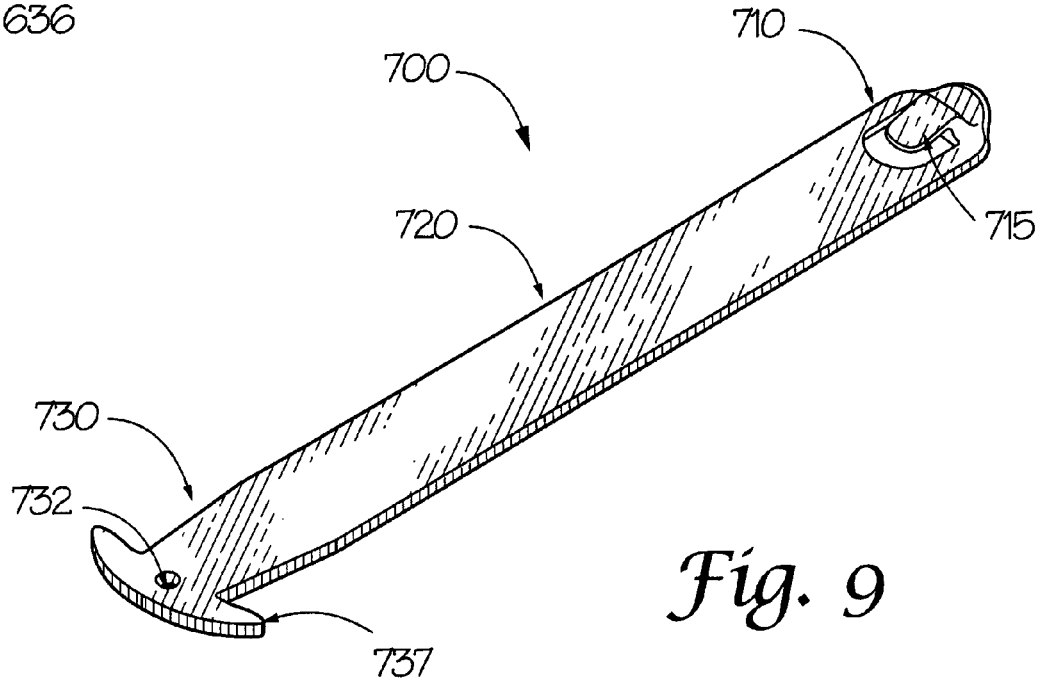
FIG. 9 shows a perspective view of a seventh exemplary embodiment of a coupling member according to this invention.

FIG. 9 shows a second exemplary embodiment of a coupling member according to this invention. As shown in FIG. 9, the coupling member 700 comprises a hook or catch 715 formed from a portion of a first end portion 710 and a "T"-handle protrusion 737 formed integral to a portion of the second end portion 730.

The hook or catch 715 formed from the first end portion 710 allows the first end portion 710 of the coupling member 700 to be removably secured to a last accessory webbing or carrier webbing when the coupling member 700 has been interwoven between aligned carrier tunnel segments and accessory tunnel segments.

The "T"-handle protrusion 737 on the second end portion 730 provides a user with a convenient area to hold the coupling member 700 when inserting or removing the coupling member 700. Additionally, the "T"-handle protrusion 737 on the second end portion 730 extends outward, a distance beyond the intermediate portion 720, so as to keep the "T"-handle protrusion 737 from traveling through a carrier tunnel segment or an accessory tunnel segment.

As shown in FIG. 9, the second end portion 730 also includes an optional aperture 732, which may be used, for example, to attach a lanyard or strap to the coupling member. It should be appreciated that, in various exemplary embodiments, the first end portion 710 may optionally include an appropriate aperture 712 (not shown). It should also be appreciated that the aperture(s) 712 and/or 732, if included may take any size or shape.

Figure 10:
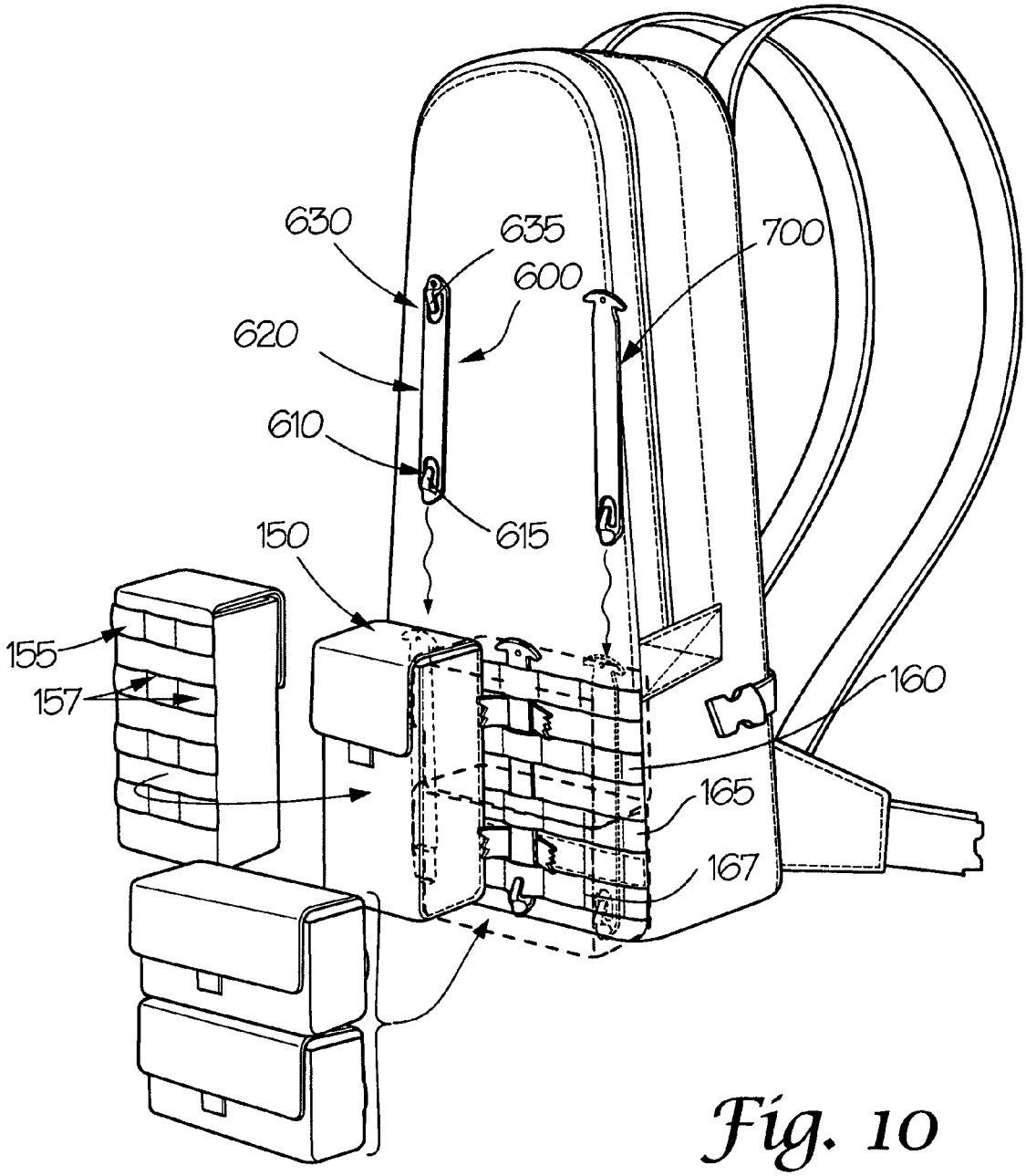
FIG. 10 shows a perspective view of a eighth exemplary embodiment of a coupling member according to this invention.

FIG. 10 shows a perspective view of the coupling member 600 and the coupling member 700 used to removably attach an accessory to a carrier, according to this invention. The coupling members 600 and 700 are formed so as to removably attach at least one accessory to a carrier.

As shown in FIG. 10, an exemplary carrier 160 includes a plurality of substantially parallel, spaced apart carrier webbings 165. Each of the carrier webbings 165 is secured to the carrier 160 at spaced apart locations 167, such that a carrier tunnel segment is formed between the carrier 160 and the carrier webbing 165 between each secured location 167 of the carrier webbing 165. Each of the carrier tunnel segments is formed substantially perpendicular to a longitudinal direction of the carrier webbing 165.

Similarly, an exemplary accessory pouch 150 includes a plurality of substantially parallel, spaced apart accessory webbings 155. The accessory webbings 155 are spaced apart so as to correspond to the spaces between the spaced apart carrier webbings 165. The accessory webbings 155 are secured to the accessory pouch 150 at spaced apart locations 157, such that an accessory tunnel segment is formed between the accessory pouch 150 and the accessory webbing 155 between each secured location 157 of the accessory webbing 155. Each of the accessory tunnel segments is formed substantially perpendicular to a longitudinal direction of the accessory webbing 155.

As further shown in FIG. 10, the accessory pouch 150 is being attached to the carrier 160 to illustrate exemplary attachment of an accessory using the coupling member 600. When the accessory pouch 150 is placed adjacent the carrier 160 such that the accessory webbings 155 are within the spaces between the spaced apart carrier webbings 165 (and the carrier webbings 165 are within the spaces between the spaced apart accessory webbings 155) and corresponding carrier tunnel segments and accessory tunnel segments are aligned, the coupling member 600 may be interwoven between the aligned carrier tunnel segments and accessory tunnel segments to removably attach the accessory pouch 150 to the carrier 160.

In various exemplary embodiments, when the coupling member 600 has been laced through an initial carrier tunnel segment, the coupling member 600 is then laced through an initial accessory tunnel segment. When the coupling member 600 has been laced through the initial accessory tunnel segment, the coupling member 600 is then laced through a subsequent corresponding carrier tunnel segment. When the coupling member 600 has been laced through the subsequent corresponding carrier tunnel segment, the coupling member 600 is then laced through a subsequent corresponding accessory tunnel segment.

The coupling member 600 continues to be interlaced between the corresponding accessory tunnel segments and carrier tunnel segments, as described above, until either the entire coupling member 600 has been interlaced between the corresponding carrier and accessory tunnel segments or a last carrier tunnel segment or accessory tunnel segment has been utilized. As the coupling member 600 is laced through the corresponding carrier and accessory tunnel segments, the accessory pouch 150 is drawn towards and removably attached to the carrier 160.

As described above, the coupling member 600 is first laced through an initial carrier tunnel segment. However, it should be appreciated that, in various exemplary embodiments, the coupling member 600 may first be laced through an initial accessory tunnel segment.

Once the coupling member 600 has been interlaced between the corresponding accessory tunnel segments and carrier tunnel segments, the hook 615 is placed around a last carrier webbing 165 to further secure the coupling member 600 within the accessory tunnel segments and carrier tunnel segments. It should be appreciated that once the coupling member 600 has been interlaced between the corresponding accessory tunnel segments and carrier tunnel segments, the hook 615 may alternatively be placed around a last accessory webbing 155.

Once the coupling member 600 has been interlaced between the corresponding accessory tunnel segments and carrier tunnel segments, the optional hook 635, if included, is placed around a first carrier webbing 165 to further secure the coupling member 600 within the accessory tunnel segments and carrier tunnel segments. It should be appreciated that once the coupling member 600 has been interlaced between the corresponding accessory tunnel segments and carrier tunnel segments, the optional hook 635 may alternatively be placed around a first accessory webbing 155.

While the coupling member 600 has been described as being interlaced between the corresponding accessory tunnel segments and carrier tunnel segments, such that both a first end portion 610 and a second end portion 630 of the coupling member 600 are removably secured to a last accessory webbing 155 and a first accessory webbing 155, respectively (or a last carrier webbing 165 and a first carrier webbing 165, respectively), the coupling member 600 may be formed so as to allow the first end portion 610 to be removably secured to an accessory webbing 155 and the second end portion 630 to be removably secured to a carrier webbing 165, or vice versa.

Thus, while the embodiments of the coupling members illustrated in FIG. 10 show the coupling member 600 interlaced through four carrier tunnel segments and three accessory tunnel segments, it should also be appreciated that the coupling member 600 may be interlaced through as few as one carrier tunnel segment and one accessory tunnel segment to provide at least some connection between the accessory pouch 150 and the carrier 160.

While it is possible to achieve a minimal connection between an accessory and a carrier by interlacing the coupling member 600 through as few as one carrier tunnel segment and one accessory tunnel segment, the greater the number of interlaced carrier tunnel segments and accessory tunnel segments, the greater the connection between the accessory and the carrier.

It should also be appreciated that the coupling member 600 may be used alone or in conjunction with other similar coupling members to removably attach accessories to a carrier or platform. Thus, multiple coupling members may be used to removably attach an accessory to a carrier.

Because the total number of spaced apart carrier webbings 165 and spaced apart accessory webbings 155 may vary, the total length of the coupling member 600 may vary. The overall size of the coupling member of this invention is a design choice based on the desired appearance and functionality of the coupling member.

Figure 11:
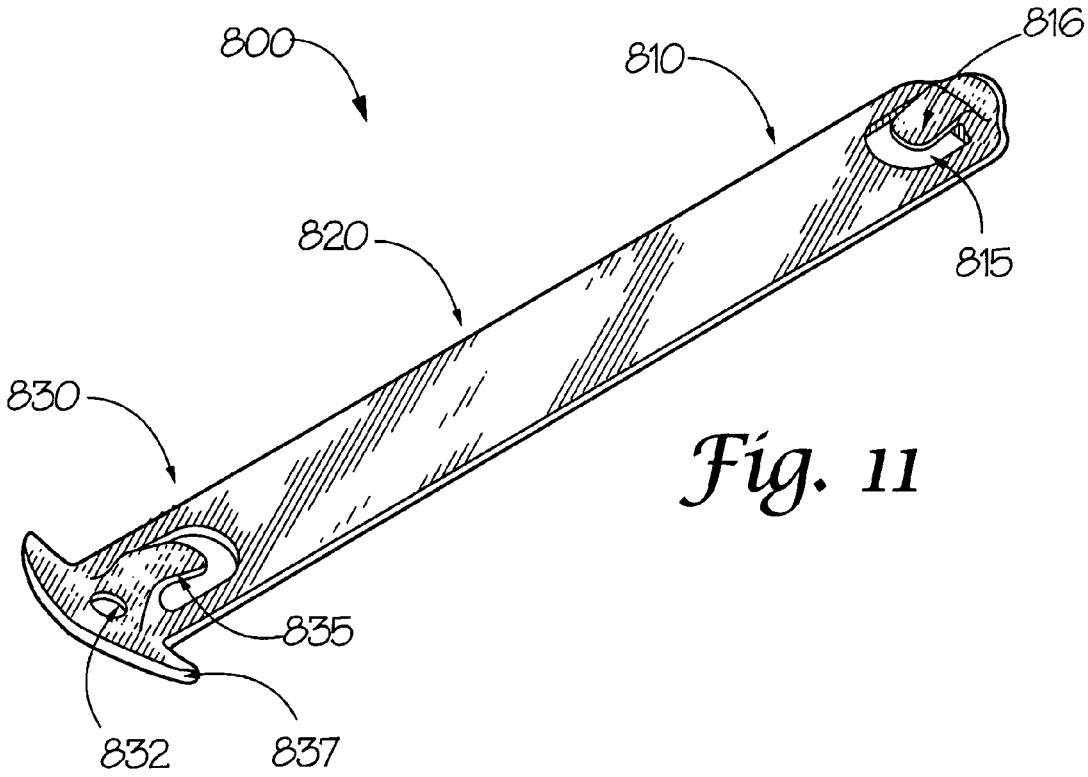
FIG. 11 shows a perspective view of a ninth exemplary embodiment of a coupling member according to this invention.

FIG. 11 shows an eighth exemplary embodiment of a coupling member according to this invention. As shown in FIG. 11, the coupling member 800 comprises a first hook or catch 815 formed from a portion of a first end portion 810 and an second hook or catch 835 formed from a portion of a second end portion 830. Additionally, the coupling member 800 further comprises a "T"-handle protrusion 837 formed integral to a portion of the second end portion 830.

As shown in FIG. 11, the second end portion 830 also includes an optional aperture 832, which may be used, for example, to attach a lanyard or strap to the coupling member. It should be appreciated that, in various exemplary embodiments, the first end portion 810 may optionally include an appropriate aperture 812 (not shown). It should also be appreciated that the aperture(s) 812 and/or 832, if included may take any size or shape.

Figure 12:
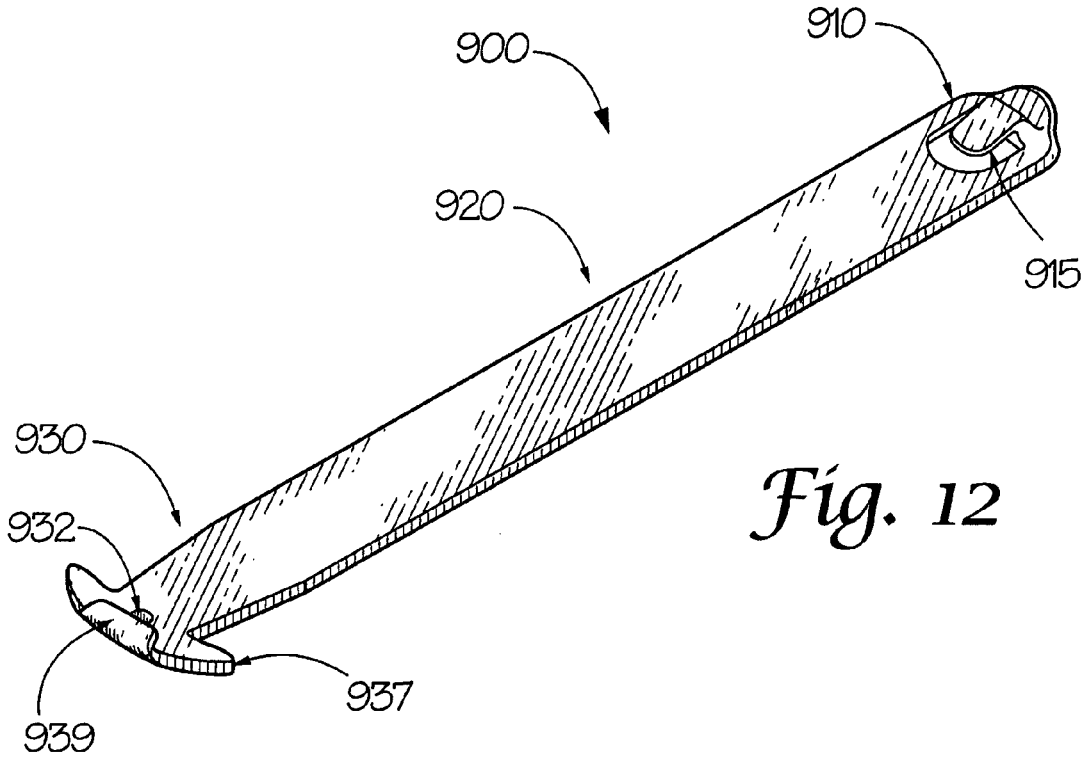
FIG. 12 shows a perspective view of a tenth exemplary embodiment of a coupling member according to this invention.

FIG. 12 shows a ninth exemplary embodiment of a coupling member according to this invention. As shown in FIG. 12, the coupling member 900 comprises a hook or catch 915 formed from a portion of a first end portion 910 and a "T"-handle protrusion 937 formed integral to a portion of the second end portion 930.

The hook or catch 915 and the "T"-handle protrusion 937 correspond to and operate similarly to the hooks, catches, and "T"-handle protrusions described herein. However, as further illustrated in FIG. 12, the coupling member 900 also includes a small curved end portion 939 formed integral to a portion of the second end portion 930. The curved end portion 939, if included, may curve towards either side of the coupling member 900 and may be used to aid the user in insertion and removal of the coupling member 900.

As shown in FIG. 12, the second end portion 930 also includes an optional aperture 932, which may be used, for example, to attach a lanyard or strap to the coupling member. It should be appreciated that, in various exemplary embodiments, the first end portion 910 may optionally include an appropriate aperture 912 (not shown). It should also be appreciated that the aperture(s) 912 and/or 932, if included may take any size or shape.

Figure 13:
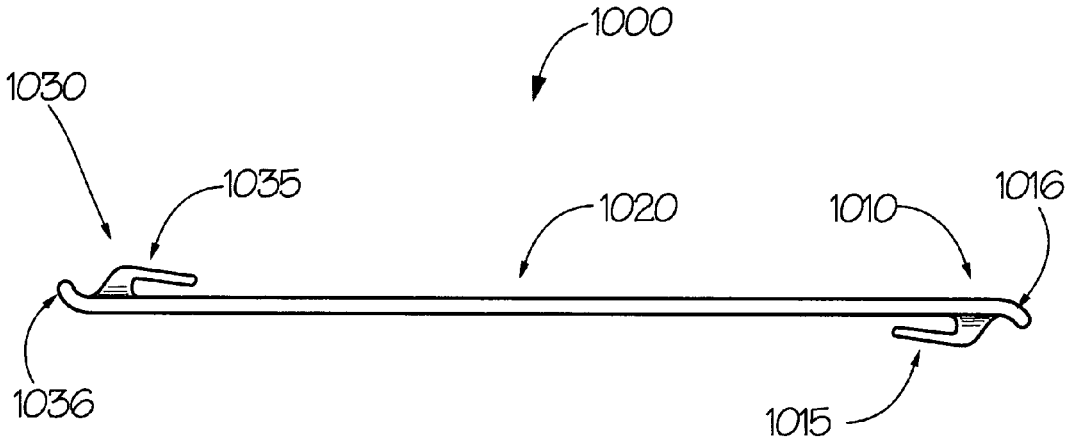
FIG. 13 shows a perspective view of a eleventh exemplary embodiment of a coupling member according to this invention.

FIG. 13 shows a side view of a tenth exemplary embodiment of a coupling member according to this invention. As shown in FIG. 13, the coupling member 1000 comprises a first end portion 1010, an intermediate portion 1020, and a second end portion 1030. A hook 1015 is formed integral to a portion of the first end portion 1010 and a hook 1035 is formed integral to a portion of the second end portion 1030.

The hook 1015 and the hook 1035 correspond to and operate similarly to the hooks described herein. However, as illustrated in FIG. 13, the hook 1015 and the hook 1035 protrude from different sides of the coupling member 1000. For example, the hook 1015 protrudes from a bottom side of the coupling member 1000 while the hook 1035 protrudes from a top side of the coupling member 1000.

It should be appreciated that the coupling member 1000 may be formed as a mirror image of the coupling member 1000 illustrated in FIG. 13, such that the hook 1015 may protrude from a top side of the coupling member 1000 while the hook 1035 may protrude from a bottom side of the coupling member 1000.

While the embodiments of the coupling member illustrated in FIGS. 1 through 12 allow both a first end portion and a second end portion of the coupling member to be removably secured to a last accessory webbing and a first accessory webbing, respectively (or a last carrier webbing and a first carrier webbing, respectively), the coupling member 1000 allows the first end portion 1010 to be removably secured to an accessory webbing and the second end portion 1030 to be removably secured to a carrier webbing, or vice versa.

Thus, while the embodiments of the coupling member illustrated in FIGS. 1 through 14 typically require a combination of an even/odd number of carrier and accessory webbings (i.e., two accessory webbings and one carrier webbing or two carrier webbings and one accessory webbing), the coupling member 1000 may be utilized with as few as one accessory webbing and one carrier webbing.

As illustrated in FIG. 13, a portion of the first end portion 1010 and/or the second end portion 1030 may optionally include a curved end portion 1016 and/or 1036, respectively. In various exemplary embodiments, the curved end portion 1016 and/or the curved end portion 1036 may curve towards a top side of the coupling member 1000 or curve towards a bottom side of the coupling member 1000. The curved end portion 1016 and/or the curved end portion 1036 may curve in the same direction or in opposite directions relative to one another. Alternatively, the first end portion 1010 and/or the second end portion 1030 may terminate in a relatively planar end portion.

Figure 14:
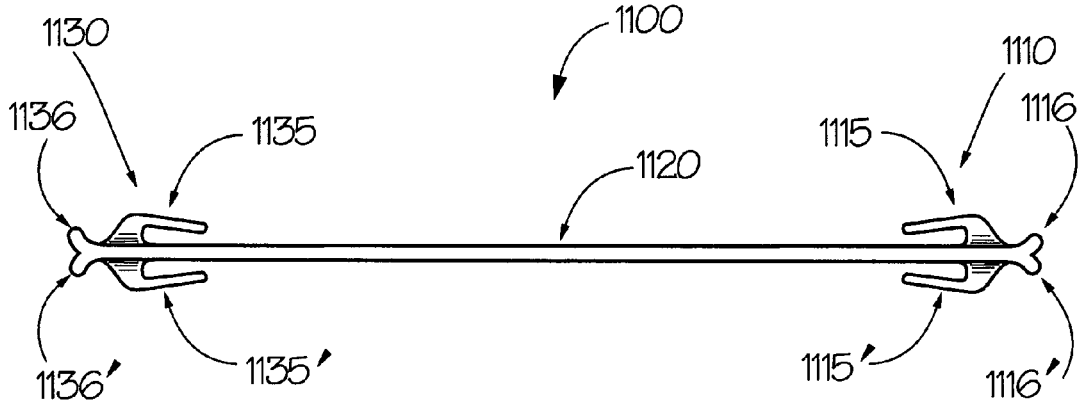
FIG. 14 shows a perspective view of a sixth and seventh exemplary embodiment of a coupling member used to removably attach an accessory to a carrier, according to this invention.

FIG. 14 shows a side view of an eleventh exemplary embodiment of a coupling member according to this invention. As shown in FIG. 14, the coupling member 1100 comprises a first end portion 1110, an intermediate portion 1120, and a second end portion 1130.

A hook 1115 is formed from a top portion of the first end portion 1110, while a hook 1115' is formed from a bottom portion of the first end portion 1110. Additionally, a hook 1135 is formed from a top portion of the second end portion 1130, while a hook 1135' is formed from a bottom portion of the first end portion 1130.

While FIG. 14 illustrates hooks 1115 and 1115' included at the first end portion 1110 and hooks 1135 and 1135' included at the second end portion 1130, any combination of hooks may be included at the first end portion 1110 and/or the second end portion 1130. For example, the coupling member 1100 may include both hooks 1115 and 1115' at the first end portion 1110 and a single hook 1135 or 1135' at the second end portion 1130. Alternatively, the coupling member 1100 may include a single hook 1115 or 1115' at the first end portion 1110 and both hook 1135 and 1135' at the second end portion 1130.

As also illustrated in FIG. 14, a portion of the first end portion 1110 may optionally include a curved end portion 1116, which curves substantially upward from the first end portion 1110, and/or a curved end portion 1116', which curves substantially downward from the first end portion 1110. Likewise, a portion of the second end portion 1130 may optionally include a curved end portion 1136, which curves substantially upward from the second end portion 1130, and/or a curved end portion 1136', which curves substantially downward from the second end portion 1130. It should be appreciated that the first end portion 1110 and/or the second end portion 1130 may terminate in a single curved end portion, multiple curved end portions, or a relatively planar end portion.

The hooks 1115, 1115', 1135, and 1135' correspond to and operate similarly to the hooks described herein. However, having a hook protrude from both a top side and a bottom side of the coupling member 1100 provides the coupling member 1100 with the ability to be removably secured to an accessory webbing or a carrier webbing.

While not illustrated in FIG. 14, in various exemplary embodiments, the coupling member 1100 may optionally comprise one or more protrusions formed integral to a portion of the first end portion 1110 and/or the second end portion 1130. In various exemplary, non-limiting embodiments, the protrusions may form a type of "T"-handle, such as those described with respect to the "T"-handle protrusions 737, 837, or 937.

As shown in FIGS. 1-14, certain end portions of the various coupling members also include one or more optional apertures, which may be used, for example, to attach a lanyard or strap to the coupling member. It should be appreciated that the aperture(s), if included, may take any size or shape.

While this invention has been described in conjunction with the exemplary embodiments outlined above, it is evident that many alternatives, modifications, and variations will be apparent to those skilled in the art. Such adaptations and modifications should and are intended to be comprehended within the meaning and range of equivalents of the disclosed exemplary embodiments. It is to be understood that the phraseology of terminology employed herein is for the purpose of description and not of limitation. Accordingly, the foregoing description of the exemplary embodiments of the invention, as set forth above, are intended to be illustrative, not limiting. Various changes, modifications, and/or adaptations may be made without departing from the spirit and scope of this invention.

What is claimed is:

1. A system for removably securing at least one accessory to a carrier, comprising:

a carrier, wherein the carrier includes a plurality of substantially parallel, spaced apart carrier webbings, wherein the carrier webbings are secured to the carrier at spaced apart locations, such that a carrier tunnel segment is formed between the carrier and the carrier webbing between each secured location of the carrier webbing, and wherein each carrier tunnel segment is substantially perpendicular to a longitudinal direction of the carrier webbing;

at least one accessory, wherein the accessory includes a plurality of substantially parallel, spaced apart accessory webbings, wherein the accessory webbings are spaced apart so as to correspond to spaces between the spaced apart carrier webbings, wherein the accessory webbings are secured to the accessory at spaced apart locations, such that an accessory tunnel segment is formed between the accessory and the accessory webbing between each secured location of the accessory webbing, and wherein each accessory tunnel segment is substantially perpendicular to a longitudinal direction of the accessory webbing; and a coupling member, wherein the coupling member comprises an elongate portion of material having a first end portion, an intermediate portion, and a second end portion, wherein, when in use, the coupling member is removably positioned within the carrier tunnel segments and the accessory tunnel segments in an interwoven fashion, and wherein the coupling member is independent from the carrier and the accessory, and wherein the coupling member includes a hook extending from a portion of the first end portion of the coupling member, wherein the hook extending from the first end portion allows the first end portion of the coupling member to be removably secured to the accessory webbing or the carrier webbing by being placed around at least a portion of an accessory webbing or carrier webbing when the coupling member has been interwoven between aligned carrier tunnel segments and accessory tunnel segments of an accessory and carrier, and wherein the coupling member includes a hook extending from a portion of the second end portion of the coupling member, wherein the hook extending from the second end portion allows the second end portion of the coupling member to be removably secured to the accessory webbing or the carrier webbing by being placed around at least a portion of an accessory webbing or carrier webbing when the coupling member has been interwoven between aligned carrier tunnel segments and accessory tunnel segments of an accessory and carrier.

2. The system of claim 1, wherein the hook extending from a portion of the first end portion is formed integral to a portion of the first end portion.

3. The system of claim 1, wherein the hook extending from a portion of the first end portion extends from a top side of the first end portion and wherein the coupling member further comprises an additional hook extending from a bottom side of the first end portion.

4. The system of claim 1, wherein the hook extending from a portion of the second end portion is formed integral to a portion of the second end portion.

5. The system of claim 1, wherein the hook extending from a portion of the second end portion extends from a top side of the second end portion and wherein the coupling member further comprises an additional hook extending from a bottom side of the second end portion.

6. The system of claim 1, wherein the accessory and carrier are a S.T.R.I.K.E.-compatible accessory and carrier.

7. The system of claim 1, wherein at least one end portion of the coupling member terminates in a curved end portion.

8. The system of claim 1, wherein at least one end portion of the coupling member terminates in a relatively blunt terminal end.

9. The system of claim 1, wherein at least one end portion of the coupling member includes at least one aperture formed in the end portion.

10. The system of claim 1, wherein the coupling member is formed of a rigid material.

11. The system of claim 1, wherein the coupling member is formed of a semi-rigid material.

12. The system of claim 1, further comprising a "T"-handle protrusion formed from a portion of the second end portion, wherein the "T"-handle protrusion extends outward, beyond a width of the intermediate portion.

* * * * *